US007576480B2

(12) United States Patent
Stark

(10) Patent No.: US 7,576,480 B2
(45) Date of Patent: Aug. 18, 2009

(54) HALOGEN INCANDESCENT LAMP AND METHOD FOR ITS PRODUCTION

(75) Inventor: Roland Stark, Wellheim (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 353 days.

(21) Appl. No.: 11/409,091

(22) Filed: Apr. 24, 2006

(65) Prior Publication Data

US 2006/0238121 A1 Oct. 26, 2006

(30) Foreign Application Priority Data

Apr. 25, 2005 (DE) ..... 10 2005 019 113

(51) Int. Cl.
*H01K 1/14* (2006.01)
*H01K 1/50* (2006.01)

(52) U.S. Cl. ..... 313/315; 313/578

(58) Field of Classification Search ..... 313/317–318.1, 313/315, 578, 634
See application file for complete search history.

(56) References Cited

U.S. PATENT DOCUMENTS 4,173,730 A * 11/1979 Young et al. ..... 315/53
4,208,604 A * 6/1980 Couwenberg ..... 313/113
4,754,197 A * 6/1988 Zwald ..... 315/57
5,384,510 A * 1/1995 Arnold ..... 313/316
5,610,477 A * 3/1997 Ivanov et al. ..... 313/573
6,054,806 A * 4/2000 Holzer ..... 313/493
6,075,318 A * 6/2000 Noll et al. ..... 313/573
2002/0067109 A1* 6/2002 Spiro et al. ..... 313/113
2004/0183444 A1* 9/2004 Nishio et al. ..... 313/634
2006/0170361 A1* 8/2006 Brock et al. ..... 313/634

FOREIGN PATENT DOCUMENTS

DE 197 01 794 7/1998
EP 0 446 460 9/1991

* cited by examiner

*Primary Examiner*—Toan Ton
*Assistant Examiner*—Bumsuk Won

(57) ABSTRACT

The present invention relates to an electrical incandescent lamp (1), in particular a halogen incandescent lamp, in which luminous element limbs (14, 16) extend in lamp vessel structural parts (42, 44), the lamp vessel structural parts surrounding the luminous element limbs in sections at a distance, and the axes of the lamp vessel structural parts (42, 44) extending at a distance from one another in order to increase the energy efficiency of the incandescent lamp, in particular if a layer (42*a*, 44*a*) which reflects IR radiation is applied to the lamp vessel structural parts. When using the pinch-sealing technology, it is possible to achieve a small system voltage halogen lamp having a long life expectancy and at the same time requiring little energy for reaching the operating temperature.

7 Claims, 3 Drawing Sheets

HALOGEN INCANDESCENT LAMP AND METHOD FOR ITS PRODUCTION

TECHNICAL FIELD

The invention relates to a halogen incandescent lamp in accordance with the precharacterizing clause of patent claim 1.

BACKGROUND ART

Such a mini system voltage halogen lamp is described, for example, on the Internet domain www.osram.de under the product designation "OSRAM HALOPIN®". Bulb pinch technology is used with this halogen incandescent lamp in order to obtain a robust lamp. Owing to the small size and owing to the possibility for use without a protective cover, this mini system voltage halogen lamp makes filigree halogen luminaires possible with a simple design. The bulb pinch technology is described in detail in the European patent specification EP 0 446 460 B1.

In order to increase the efficiency of a halogen incandescent lamp, it is known to those skilled in the art from, for example, the laid-open specification U.S. Pat. No. 6,111,344 to apply a coating which reflects IR radiation to a lamp bulb which satisfies special design requirements.

Owing to the design of the lamp bulb using bulb pinch technology which is very different from the design in the laid-open specification U.S. Pat. No. 6,111,344, those skilled in the art do not consider a coating which reflects IR radiation on a lamp bulb of a halogen incandescent lamp for which bulb pinch technology is used for significantly increasing the efficiency.

DISCLOSURE OF THE INVENTION

The invention is based on the object of providing a halogen incandescent lamp with which the luminous efficiency is increased given the same life and of providing a method for its production.

This object is achieved according to the invention by the features of claim 1. Particularly advantageous embodiments of the invention are described in the dependent claims.

The electrical incandescent lamp according to the invention has a lamp vessel which is sealed at one end, in which at least one luminous element is accommodated, and which has two essentially rotationally symmetrical lamp vessel structural parts. Each of the lamp vessel structural parts surrounds a luminous element limb at least in sections, and the axes of the lamp vessel structural parts are designed to be spaced apart from one another. Such a design makes it possible to optimize the thermal performance of the luminous element and to operate the incandescent lamp in a more energy-efficient manner.

At least one wall face of the lamp vessel structural parts is preferably provided at least partially with a layer which reflects IR radiation, as a result of which the IRC effect is improved in the incandescent lamp and thus less energy needs to be supplied from the outside in order to bring the luminous element to the operating temperature.

In accordance with one advantageous design, the lamp vessel structural parts intersect one another. The overall size of the electrical incandescent lamp can thus be reduced.

One improvement in terms of production and with respect to a more uniform reflection onto the luminous element can be achieved by an essentially cylindrical design of the lamp vessel structural parts.

A robust lamp design can be achieved by the use of retaining pinches directly in the lamp bulb, in which case a long life is ensured even in the event of the lamp being subjected to a mechanical load. The use of the present invention is not restricted to the pinch-sealing technology, however, but the abovementioned design of the lamp vessel structural parts can also be used in luminous elements which are fixed in position by means of a support frame.

The axial extent of the luminous element limbs in the lamp vessel structural parts, in particular the extent of the luminous element limbs along the respective central axis of the lamp vessel structural parts, has an advantageous effect. The reflection of heat onto the luminous element is thereby brought to an optimum value.

In one method according to the invention for producing an abovementioned incandescent lamp, deformation of the lamp vessel so as to form the two lamp vessel structural parts is carried out at the same time as the main pinch sealing, with the result that a short production time is maintained.

The application of the layer which reflects IR radiation preferably takes place after deformation of the lamp vessel, while the pinch sealing is carried out prior to deformation. It is thus possible to effectively produce an energy-optimized incandescent lamp.

BRIEF DESCRIPTION OF THE DRAWINGS

The invention will be explained in more detail below with reference to a preferred exemplary embodiment. In the figures.

BEST MODE FOR CARRYING OUT THE INVENTION

FIGS. 1 to 5 show a halogen incandescent lamp 1 which is designed for operation using the system voltage. In principle, however, the invention can also be used for low-voltage or medium-voltage halogen incandescent lamps.

Figure 1:
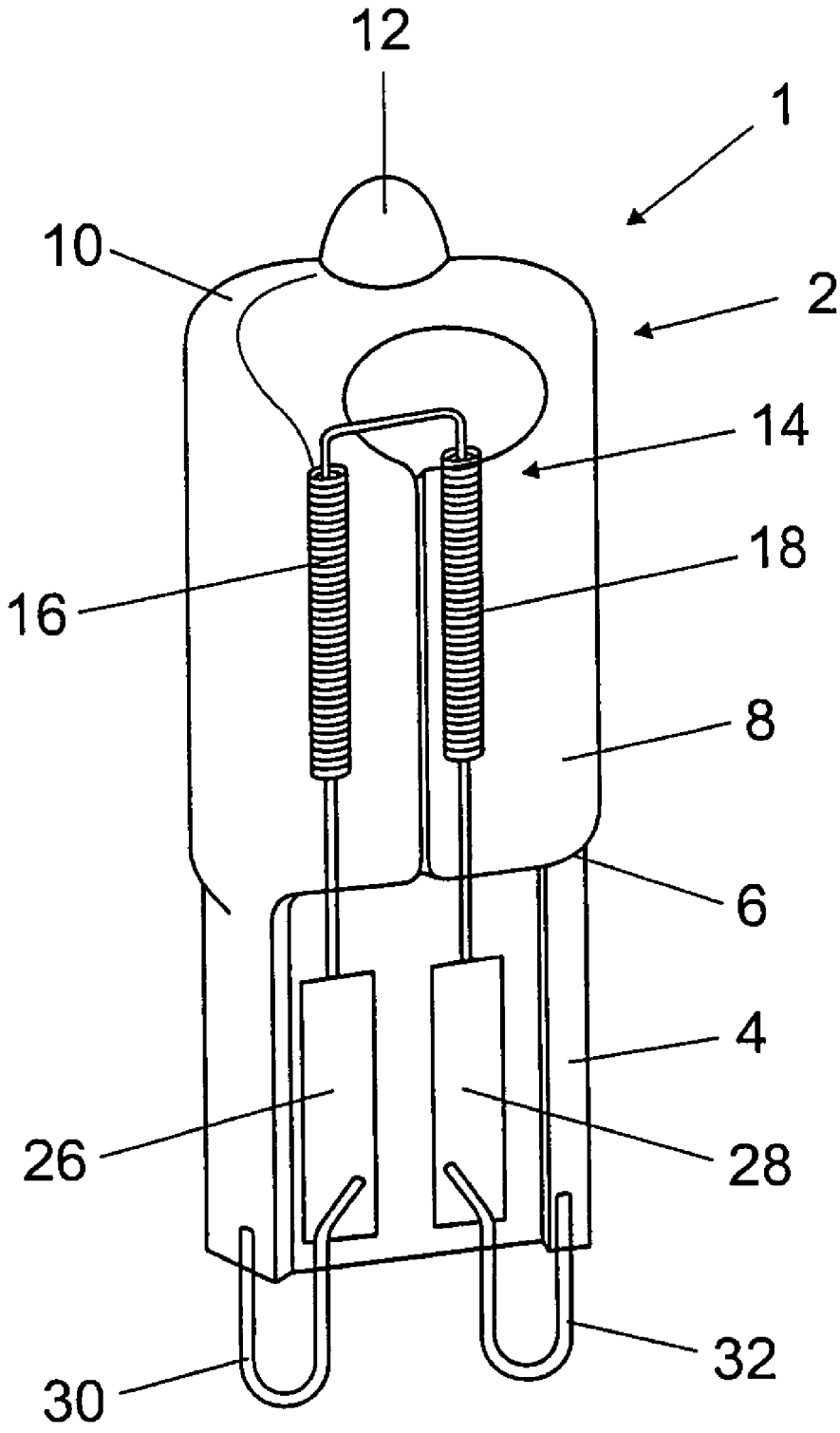
FIG. 1 shows a perspective view of a halogen incandescent lamp according to the invention.
Figure 2:
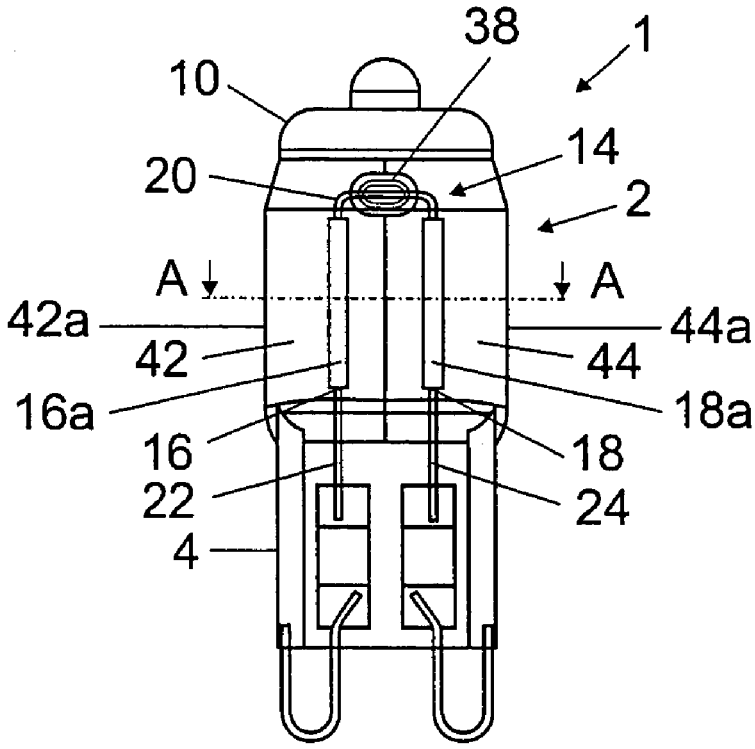
FIG. 2 shows a front view of the halogen incandescent lamp shown in FIG. 1.
Figure 3:
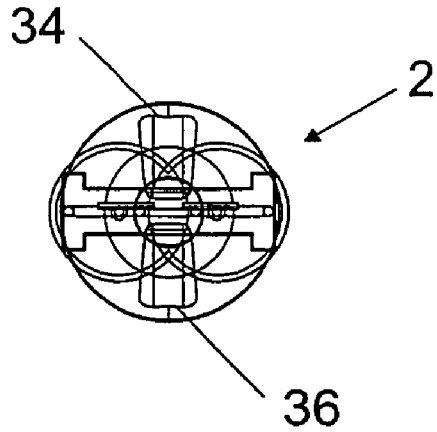
FIG. 3 shows a plan view of the halogen incandescent lamp shown in FIG. 1.
Figure 4:
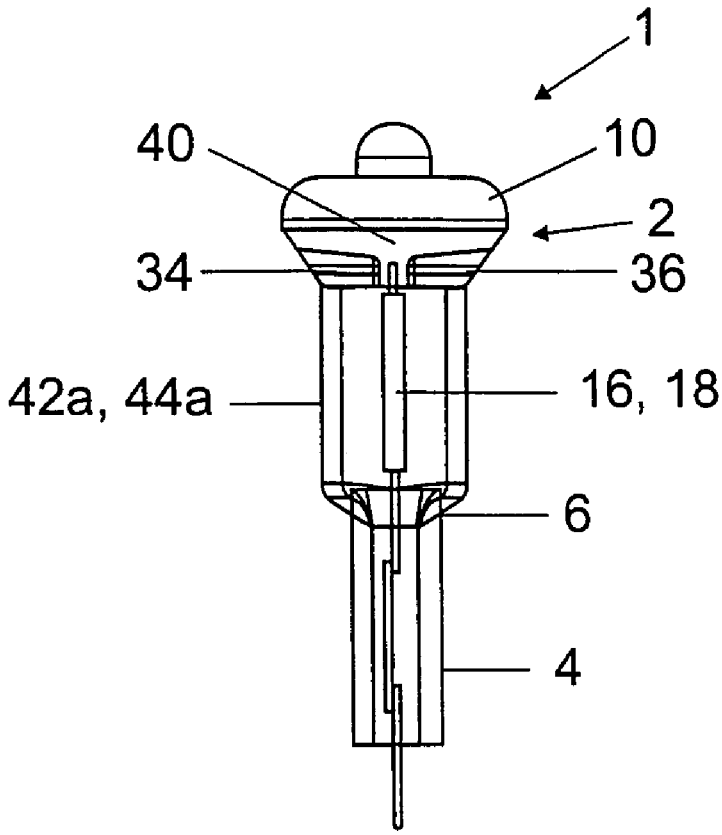
FIG. 4 shows a side view of the halogen incandescent lamp shown in FIG. 1.
Figure 5:
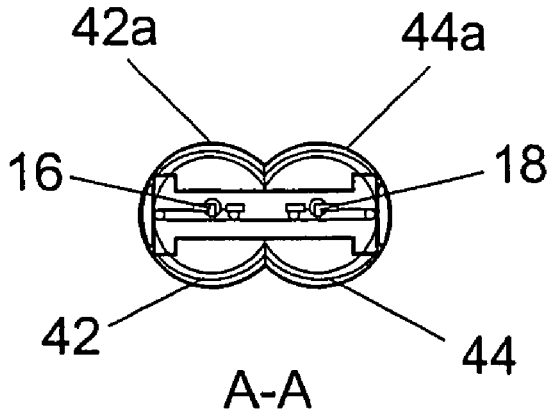
FIG. 5 shows a section along the line A-A in FIG. 2.

As shown in FIGS. 1, 2 and 4, the halogen incandescent lamp 1 has a lamp vessel 2, which is preferably made from quartz glass and at whose end section (at the bottom in FIG. 1) a base 4 is formed by means of a pinch seal, it being possible for said base 4 to be inserted into a lampholder (not illustrated). This base 4 merges with a bulb 8 of the lamp vessel 2 via a circumferential bevel 6, which is likewise illustrated in FIG. 4. That end section of the lamp vessel 2 which is remote from the base 4 is formed by a dome 10, on which an exhaust tube attachment 12 is formed.

Arranged in the lamp vessel 2 is a luminous element 14 which, in the exemplary embodiment described, is designed to have two luminous element limbs 16, 18, on which the filament sections 16*a*, 18*a* are located which are connected to one another via a connecting part 20. As can be seen in FIG. 2, the luminous element limbs 16, 18 extend essentially parallel to one another. The two luminous element limbs 16, 18 merge with power supply lines 22, 24, whose end sections penetrate the base 4 formed by the pinch seal and are connected to in each case one molybdenum foil 26, 28 (shown in FIG. 1), which are likewise embedded in the base 4. These molybdenum foils 26, 28 are in turn connected to approximately U-shaped outer power supply lines, referred to below as contacts 30, 32, whose bent-back end sections penetrate channels in the base 4 or are embedded in said channels. The luminous element limbs 16, 18, the connecting part 20 and the two power supply lines 22, 24 are preferably produced from tungsten.

The two power supply lines 22, 24 embedded in the base 4 are not stable enough to hold the two luminous element limbs 16, 18 in their predetermined relative position within the bulb 8. Retaining pinches 34, 36 are therefore formed on the lamp vessel 2 approximately at the height of the connecting part 20, said retaining pinches 34, 36 being arranged, in the illustration shown in FIG. 2, at right angles to the plane of the drawing and extending, in the illustration shown in FIG. 3, in the vertical direction and, in FIG. 4, parallel to the plane of the drawing. The retaining pinches 34, 36, which lie diametrically opposite one another, are formed by inwardly (towards the intermediate part 20) deformed wall regions of the bulb 8, i.e. the wall of the bulb is deformed inwards in the region of these retaining pinches 34, 36 in order to clamp the connecting part 20 between the two end faces of the retaining pinches 34, 36 and thus to fix the luminous element limbs 16, 18 in position. This bulb pinch technology is explained in detail in EP 0 446 460 B1 cited at the outset.

In the exemplary embodiment illustrated, the bulb 8 has two intersecting, cylindrical bulb structural parts 42, 44 adjacent to the circumferential bevel 6, the luminous element limbs 16, 18 being arranged along the central axes of said bulb structural parts 42, 44. The intersecting, cylindrical bulb structural parts 42, 44 form essentially the shape of an eight in the sectional view in FIG. 5 along the line A-A from FIG. 2. The cylindrical bulb structural parts 42, 44 merge with the dome 10 via a transition region 40, in which the above-described retaining pinches 34, 36 are formed. The transition region 40 takes the shape of the intersecting cylinders of the bulb structural parts 42, 44 and links up these bulb structural parts 42, 44 with the dome 10, which is circular in the exemplary embodiment.

In the region of the cylindrical bulb structural parts 42, 44, an infrared coating (IRC) is applied to the wall surface 42*a*, 44*a* of the bulb 10, by means of which infrared coating the heat is reflected back onto the luminous element limbs 16, 18. Owing to such a reflection, the heat remains within the lamp and less energy needs to be supplied from the outside in order to bring the luminous element limbs 16, 18 to the temperature.

The retaining pinches 34, 36 are each formed with an approximately elliptical cross section, whose longitudinal axis overlaps that region 38 of the connecting part 20 which is arranged horizontally in FIG. 2 in order to achieve a maximum connection area between the elliptical end sides of the retaining pinches 34, 36 and the connecting part 20.

During manufacture, once the luminous element 14 has been introduced into an unmachined quartz-glass part, initially the retaining pinches 34, 36 are pinched in order to retain the luminous element 14. Then, the bulb 8 is deformed such that the two intersecting bulb structural parts 42, 44 are obtained, the luminous element limbs 16, 18 with the filaments extending axially with respect to a respective bulb structural part 42, 44. At the same time as the bulb is deformed, the main pinch sealing takes place, with which the base 4 is formed. Subsequently, an exhaust tube is attached to the exhaust tube attachment 12, by means of which exhaust tube the interior of the bulb 8 is evacuated and is filled with a filling gas containing halogens. The high luminous efficiency owing to the infrared coating is assisted by a xenon gas filling. After filling, the exhaust tube is removed and fusing takes place so as to form the exhaust tube attachment 12.

The application of the present invention is not restricted to incandescent lamps having retaining pinches, but the rotationally symmetrical, preferably cylindrical design of the lamp vessel structural parts 42, 44 can also be applied to other lamps, such as lamps having a support frame.

Improved thermal recovery can even be achieved when the bulb 8 or the lamp vessel structural parts 42, 44 is/are only partially coated with the infrared coating.

The luminous element limbs 16, 18 preferably extend along the central axis of the lamp vessel structural parts 42, 44. An improvement in luminous efficiency can also be achieved if the luminous element limbs 16, 18 extend essentially parallel to the central axis of the lamp vessel structural parts.

In the exemplary embodiment described above, the lamp vessel structural parts 42, 44 have the same outer diameter, but it is also possible for different outer diameters to be used for the lamp vessel structural parts 42, 44 and it is possible for the outer diameter of the respective lamp vessel structural part 42, 44 to change over its axial extent, such as in the form of a truncated cone design.

The present invention relates to an electrical incandescent lamp, in particular a halogen incandescent lamp, in which luminous element limbs extend in lamp vessel structural parts, the lamp vessel structural parts surrounding the luminous element limbs in sections at a distance, and the axes of the lamp vessel structural parts extending at a distance from one another in order to increase the energy efficiency of the incandescent lamp, in particular if a layer which reflects IR radiation is applied to the lamp vessel structural parts. When using the pinch-sealing technology, it is possible to achieve a small system voltage halogen lamp having a long life expectancy and at the same time requiring little energy for reaching the operating temperature.

What is claimed is:

1. An electrical incandescent lamp comprising: a lamp vessel having a first and a second essentially rotationally symmetrical lamp vessel part, the respective parts extending in a common direction, side by side, the vessel parts having sealed ends at a common base and having connected ends displaced in the common direction from the sealed ends; and at least one luminous element having at least two luminous element limbs, the luminous element extending through at least a sealed end of the first vessel part through the first essentially rotationally symmetrical lamp vessel part around the connected ends to pass through the second essentially rotationally symmetrical lamp vessel part and through the sealed end of the second vessel part; wherein each respective rotationally symmetrical vessel part surrounds a respective luminous element limb at least in sections and wherein respective axes of the luminous element limbs are spaced apart one from another, wherein the lamp vessel parts intersect one another.

2. The electrical incandescent lamp as claimed in claim 1, the lamp vessel parts being essentially cylindrical.

3. The electrical incandescent lamp as claimed in claim 1, the luminous element being fixed in position by means of retaining pinches intermediate the sealed ends.

4. The electrical incandescent lamp as claimed in claim 1, the luminous element being fixed in position by means of a support frame.

5. The electrical incandescent lamp as claimed in claim 1, the luminous element limbs extending axially in the lamp vessel parts.

6. The electrical incandescent lamp as claimed in claim 1, the luminous element limbs extending essentially along the respective central axis of the lamp vessel parts in the lamp vessel parts.

7. The electrical incandescent lamp as claimed in claim 1, at least one circumferential wall of the lamp vessel parts being provided at least partially with a layer which reflects IR radiation.

* * * * *